US010975602B2

(12) United States Patent
Kingsbury

(10) Patent No.: US 10,975,602 B2
(45) Date of Patent: Apr. 13, 2021

(54) SECURITY LATCH FOR A SWING BAR DOOR GUARD

(71) Applicant: Alan B Kingsbury, Campbellsville, KY (US)

(72) Inventor: Alan B Kingsbury, Campbellsville, KY (US)

( * ) Notice: Subject to any disclaimer, the term of this patent is extended or adjusted under 35 U.S.C. 154(b) by 0 days.

(21) Appl. No.: 15/894,856

(22) Filed: Feb. 12, 2018

(65) Prior Publication Data

US 2018/0163445 A1 Jun. 14, 2018

Related U.S. Application Data

(63) Continuation-in-part of application No. 14/938,106, filed on Nov. 11, 2015, now abandoned.

(51) Int. Cl.
*E05C 17/16* (2006.01)
*E05C 19/18* (2006.01)
*E05B 15/02* (2006.01)

(52) U.S. Cl.
CPC ..... *E05C 17/166* (2013.01); *E05B 15/0205* (2013.01); *E05C 17/16* (2013.01); *E05C 19/182* (2013.01)

(58) Field of Classification Search
CPC ..... E05B 17/2003; E05B 17/2088; E05B 65/0032; E05B 15/0205; E05B 15/006; E05B 17/0054; E05B 17/0062; E05C 17/166; E05C 19/009; E05C 19/182; E05C 17/16; Y10S 292/15; Y10T 292/1083; Y10T 292/1084; Y10T 292/1085; Y10T 292/1087; Y10T 292/1092; Y10T 292/28; Y10T 292/289; Y10T 292/293; Y10T 292/296; Y10T 292/299; Y10T 292/444; Y10T 292/702
USPC ..... 292/202, 203, 204, 206, 210, 262, 268, 292/270, 274, 272, 304, 341.17, DIG. 15
See application file for complete search history.

(56) References Cited

U.S. PATENT DOCUMENTS 236,910 A * 1/1881 Phillips ..... E05C 17/166 292/270
251,732 A * 1/1882 Phillips ..... E05C 17/166 292/268
355,419 A * 1/1887 Sprado ..... E05C 17/166 292/268

(Continued)

FOREIGN PATENT DOCUMENTS

DE 464466 C * 8/1928 ..... E05C 17/166
GB 261652 A * 11/1926 ..... E05C 17/166

(Continued)

*Primary Examiner* — Christine M Mills
(74) *Attorney, Agent, or Firm* — Francis Law Firm PLLC; James M. Francis

(57) ABSTRACT

A security latch for a swing bar door guard having a break away rotatable cross-member to further secure the swing bar so as to permit a minimal gap between the door and doorway when the door is opened while the cross-member extends through the swing bar retaining arm passage and is rotated lengthwise across the span to secure the swing bar. The minimal gap inhibits the introduction of a tool into the span along the midsection of the swing bar that could be used to pry the swing bar members apart to release the knob of a swing bar retaining arm.

15 Claims, 9 Drawing Sheets

(56) References Cited

U.S. PATENT DOCUMENTS

| | | | | | |
|---|---|---|---|---|---|
| 416,874 | A * | 12/1889 | Trabold | E05C 17/166 | 292/270 |
| 423,082 | A * | 3/1890 | Richardson | E05C 19/18 | 292/206 |
| 473,785 | A * | 4/1892 | Samuel | E05C 17/166 | 292/268 |
| 529,963 | A * | 11/1894 | Saqui | E05C 17/166 | 292/270 |
| 543,863 | A * | 8/1895 | Hair | E05C 17/166 | 292/270 |
| 687,346 | A * | 11/1901 | Speirs | E05C 17/166 | 292/256 |
| 937,094 | A * | 10/1909 | Rosenberg | E05C 17/166 | 292/268 |
| 966,865 | A * | 8/1910 | Schuyler | E05F 11/00 | 292/204 |
| 1,286,774 | A * | 12/1918 | Rehe | E05B 63/20 | 292/262 |
| 1,596,183 | A * | 8/1926 | Horlick, Jr. | E05C 17/166 | 292/268 |
| 4,436,331 | A * | 3/1984 | Glickman | E05C 17/166 | 292/270 |
| 4,792,167 | A * | 12/1988 | King | E05B 39/025 | 292/148 |
| 5,799,521 | A * | 9/1998 | Kennedy | E05B 13/001 | 292/259 R |
| 2009/0152876 | A1 | 6/2009 | Chen | | |

FOREIGN PATENT DOCUMENTS

| | | | | |
|---|---|---|---|---|
| GB | 2260569 A * | 4/1993 | E05B 65/102 | |
| WO | WO-2008060121 A1 * | 5/2008 | E05B 63/24 | |

* cited by examiner

SECURITY LATCH FOR A SWING BAR DOOR GUARD

CROSS-REFERENCE TO RELATED APPLICATIONS

The present disclosure claims priority to U.S. Provisional Patent Application Ser. No. 62/137,220 filed on Mar. 23, 2015, entitled SECURITY LATCH FOR A SWING BAR DOOR GUARD, and currently pending U.S. application Ser. No. 14/938,106 filed on Nov. 11, 2015 also entitled SECURITY LATCH FOR A SWING BAR DOOR GUARD, to which this application is a continuation-in-part.

TECHNICAL FIELD

The present invention relates generally to latches, locks, and related devices, and particularly to a security latch for a swing bar door guard that prevents the swing bar from being opened from the opposite side of the door when the security latch is engaged with swing bar.

BACKGROUND

Various supplementary mechanical guards are known for securing doorways in a partially opened or ajar state. The most common of these supplementary guards are the chain type and the swing bar type comprising a knobbed arm affixed to one panel (generally the door) and a slotted bar (generally a staple configuration) pivotally attached to the adjacent structure (usually the jamb). The swing bar is pivoted over the knobbed arm to prevent the door from being more than slightly opened, with the arm passing through the narrower slot or passage between the swing bar members and the larger diameter knob of the arm preventing the swing bar from clearing the knob. These supplementary guards are common installations not only in the home, but also in hotels, motels, and other quarters throughout the world.

However, various means have been developed for defeating these supplementary guards, if the door is slightly ajar with the latch engaged. This may occur in a hotel or motel room if the door lock is opened by a staff member or other person with access to a key to the room. One way of defeating the swing bar door guard mechanism once the door has been unlocked and is ajar, is by drawing the door slightly toward its closed position and inserting a fairly stiff member (card stock paper, thin plastic or sheet metal, etc.) through the gap between the door and the jamb, using the paper or other member to push the swing bar clear of the arm, and then opening the door. Thus a security latch for a swing bar door guard solving the aforementioned problems is desired.

SUMMARY

The security latch for a swing bar door guard essentially includes a plate installed adjacent to or formed with the rigid arm component of the swing bar door guard assembly. The plate has a post pivotally secured thereto, and extending normal to the plane or surface of the plate. The distal end of the post, i.e., the end opposite the plate, includes a cross-member thereon so the post and its cross-member collectively form a T configuration.

The cross-member has a span or length greater than the spacing between the two members of the swing bar, but the post and narrower width of its cross-member fit easily between the two swing bar members. Thus, the swing bar may be prevented from releasing the arm when engaged therewith by moving the swing bar over the post and cross-member and then rotating the post and cross-member so the cross-member extends across the two swing bar members.

The post is preferably frictionally secured in the plate from which it extends, thus requiring some slight effort to rotate the post and its cross-member. This assures that the post and cross-member will remain in the desired orientation, e.g., with the cross-member across the members of the swing bar, once adjusted to this orientation. Stops are provided in or on the plate and extending from the post to limit the rotation of the post and its cross-member to ninety degrees, i.e., with the cross-member either aligned between the swing bar members or extending across the members. Various embodiments of the stops are provided.

Various embodiments of the plate and its post and cross-member are also provided, with one embodiment comprising a plate that is separate from the conventional plate and rigid arm component of the swing bar door guard assembly. This embodiment provides for installation of the security latch with previously installed swing bar door guards. In another embodiment, the plate and its post and cross-member are combined with the rigid arm component of the swing bar door guard, thus facilitating installation of the swing bar door guard and the security latch when both are installed together.

These and other features of the present invention will become readily apparent upon further review of the following specification and drawings. The present apparatus recognizes and addresses the previously-mentioned long-felt needs and provides utility in meeting those needs in its various possible embodiments. To one of skill in this art who has the benefits of this disclosure's teachings, other and further objects and advantages will be clear, as well as others inherent therein. The disclosures herein are not intended to limit the scope of the invention, merely to provide context with which to understand the patent claims.

BRIEF DESCRIPTION OF THE DRAWINGS

To further clarify various aspects of some example embodiments of the present invention, a more particular description of the invention will be rendered by reference to specific embodiments thereof which are illustrated in the appended drawing. It is appreciated that the drawing depicts only illustrated embodiments of the invention and are therefore not to be considered limiting of its scope. The invention will be described and explained with additional specificity and detail through the use of the accompanying drawing in which.

Similar reference characters denote corresponding features consistently throughout the attached drawings.

DETAILED DESCRIPTION

The security latch for a swing bar door guard includes a post, a cross-member connected to one end of the post, and a plate connected to a second, opposing end of the post. The plate can be installed adjacent to or formed with the rigid arm component of a swing bar door guard assembly. The post is selectively pivot able to align the cross-member with the slot between the swing bar members for passage there through, or to cross the swing bar members to prevent their release. The security latch for a swing bar door guard can prevent the release of the swing bar from its retaining rod when the door is slightly ajar.

FIGS. 1A through 3 provide illustrations of a first embodiment of the security latch for a swing bar door guard, designated as security latch 10. The swing bar door guard can be conventional, having a pivotally acting swing bar B extending from a swing bar mounting plate P1, generally affixed to the door jamb, with a retaining arm A affixed to an arm mounting plate P2, generally affixed to the edge of the door. The swing bar B is formed by two parallel members B1 and B2 having the general configuration of an elongate U. The two members B1 and B2 have a span S there between and define an arm passage for the rigid retaining arm A of the assembly. The arm A has a knob K formed on its distal end, with the knob K passing through a wider gap at the base of the swing bar B but being captured by the relatively narrower span S between the two parallel swing bar members B1 and B2.

The swing bar B is strongest at its ends, with the parallel members B1, B2 being susceptible to being pried apart so as to increase the span S along the length of the swing bar B between its ends by the introduction of a tool, e.g. a screwdriver, through the span S when the door is partially open but secured by the knob K of the retaining arm A so that it will not open to any further extent than the knob K reaching the end of the swing bar B. If the parallel members B1, B2 are pried apart and the span S is sufficiently enlarged, the knob K can be manipulated to pass through the span S, thus permitting unwanted entry. Prying the parallel members B1, B2 apart can be a completely silent task and an intruder can gain entry with little or no warning.

Figure 2:
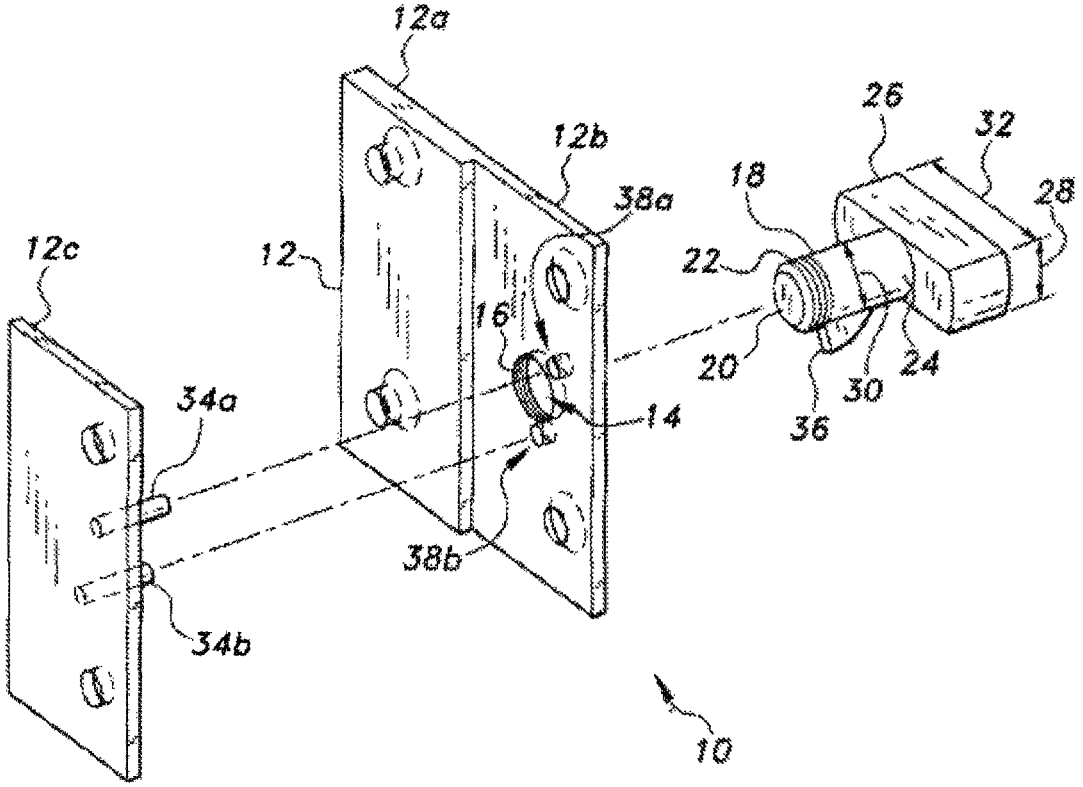
FIG. 2 is an exploded perspective view of the security latch for a swing bar door guard according to the present invention, illustrating its various components and features.

The security latch 10 includes a rigid plate 12 having a post passage 14 (shown in FIG. 2) formed therein. The post passage 14 may include internal threads 16 therein, as shown in FIG. 2, or may be unthreaded. A post 18 has an attachment end 20 installed in the post passage 14. The attachment end 20 of the post 18 includes external threads 22 to mate with the internal threads 16 of the post passage 14, or may remain unthreaded where the posts passage of the plate is unthreaded. Whether the post 18 is threaded into the post passage 14 of the plate 12 or is otherwise captured therein, the attachment end 20 of the post 18 preferably has a frictional fit within the post passage 14 in order to preclude free rotation of the post 18 relative to the plate 12. The frictional resistance allows a user of the security latch 10 to rotate the post 18 within the plate 12 using a moderate amount of force or pressure, while preventing the post 18 from freely rotating or shifting its position or orientation within the plate 12 due to vibration or other incidental forces or effects.

Figure 1A:
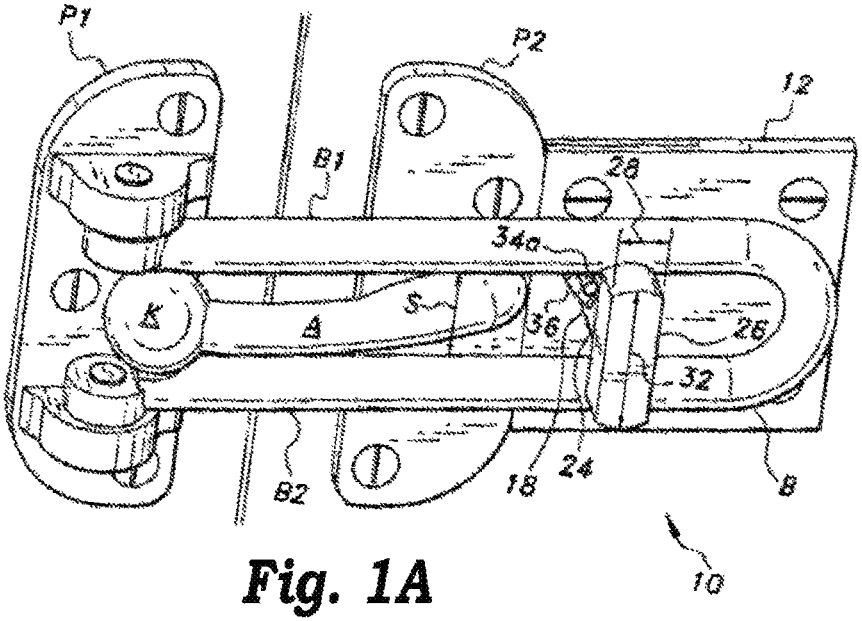
FIG. 1A is an environmental perspective view of a security latch for a swing bar door guard according to the present invention, showing the security latch engaged to prevent the opening of the swing bar.
Figure 1B:
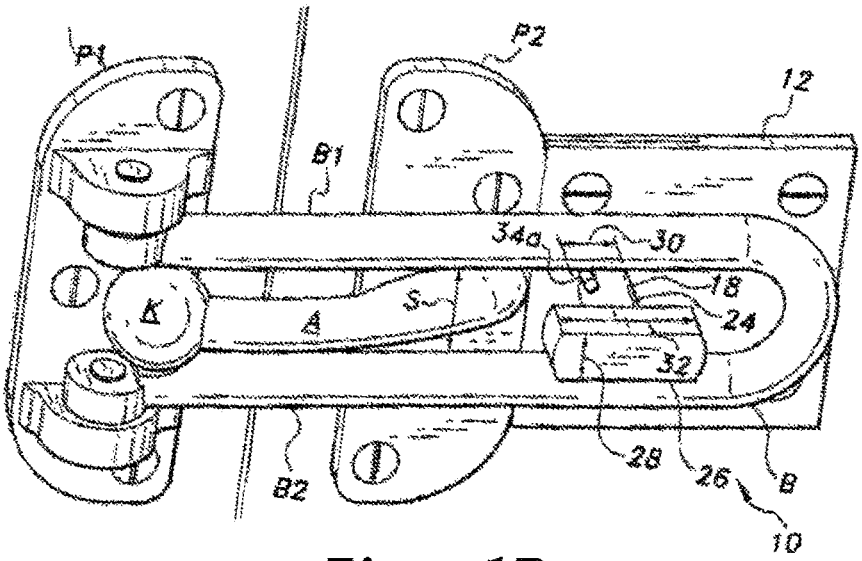
FIG. 1B is an environmental perspective view of the security latch for a swing bar door guard of FIG. 1A, showing the security latch turned to allow the swing bar to be opened.
Figure 1C:
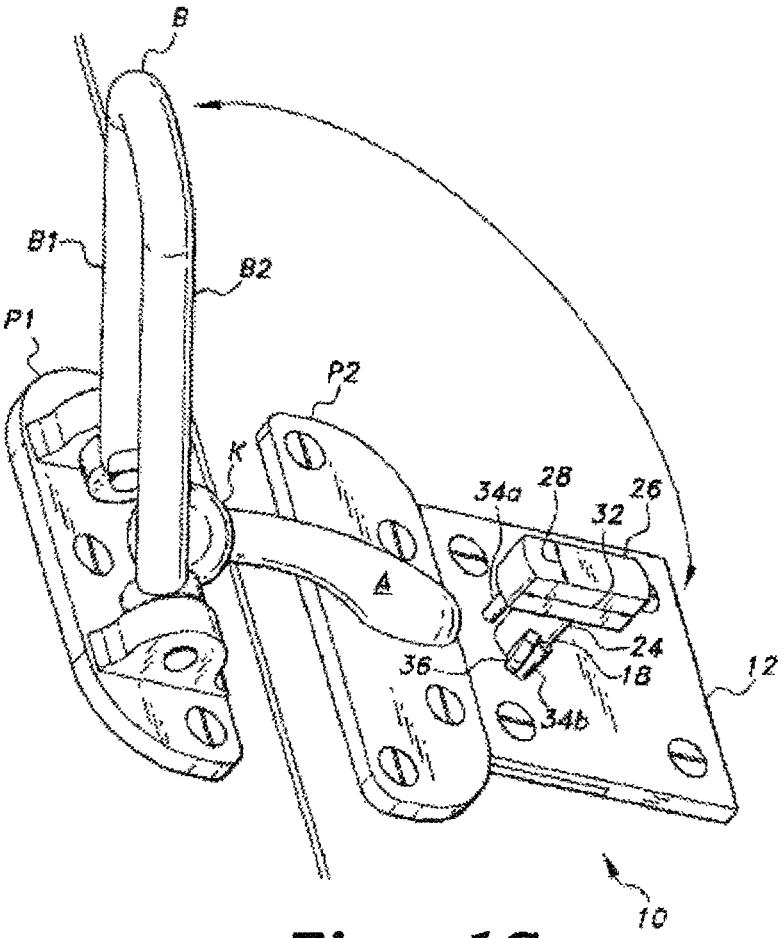
FIG. 1C is an environmental perspective view of the security latch for a swing bar door guard of FIGS. 1A and 1B, showing the swing bar swung open after disengaging the security latch.
Figure 3:
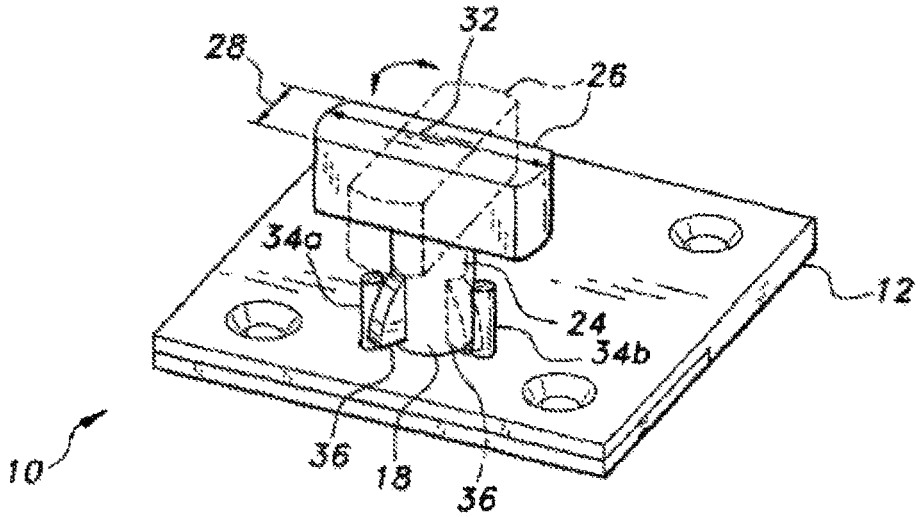
FIG. 3 is a perspective view of the security latch for a swing bar door guard according to the present invention, showing further details thereof.

The post 18 further includes a distal end 24 with a cross-member 26 attached thereto. The cross-member 26 has a width or minor dimension 28 adapted to pass through the span S between the two swing bar members B1 and B2, with the post 18 having a diameter 30 (indicated in FIGS. 1B and 2) adapted to pass through the span S between the members B1 and B2. The cross-member 26 has a length or major dimension 32 greater than the span S between the swing bar members B1 and B2. Thus, when the swing bar B is lowered over the arm A and the plate 12 of the security latch assembly 10, and the post 18 is rotated so that its cross-member 26 extends across the two swing bar members B1 and B2 as shown in FIG. 1A, the swing bar B cannot be rotated or lifted away from the security latch plate 12 and the retaining arm plate P2 and thus cannot be manipulated to clear the arm A to allow the door to be opened fully. Rotation of the post 18 and its cross-member 26 ninety degrees from the position shown in FIG. 1A, i.e. to the position shown in FIG. 1B, allows the swing bar B to be pivoted or lifted away from the plate 12 to clear the arm A as shown in FIG. 1C, thereby allowing the door to be opened fully. FIG. 3 clearly shows the two alternative positions or orientations of the cross-member 26, with a latched orientation (as in FIG. 1A) shown in solid lines and an unlatched orientation (as in FIGS. 1B and 1C) shown in broken lines.

The security latch also preferably includes means for limiting the rotation of the post 18 and its cross-member 26 to a range between the cross-member 26 lying parallel to the swing bar B and perpendicular to the swing bar B, i.e., 90 degrees. In the security latch 10 embodiment of FIGS. 1A through 3, this is achieved by post rotational stops comprising first and second stop pins 34*a* and 34*b* extending from the plate 12 and normal thereto, adjacent to the post 18, and a radial protrusion extending from the post 18 comprising a flange 36 disposed between the two pins 34*a* and 34*b*. The pins 34*a* and 34*b* define a semi-circumferential arc of slightly more than 90 degrees there between, to allow for the thickness of the flange 36. The arcuate range of rotation of the post 18 and its cross-member 26 from the flange 36 contacting the first pin 34*a* to contacting the second pin 34*b* is essentially 90 degrees.

FIG. 2 provides an exploded perspective view of an exemplary construction of the stop pins and plate. The plate 12 can include two portions, a thicker portion 12*a* and a thinner portion 12*b* formed as a unitary component. Another plate element 12*c* is formed as a separate component from the plate component 12*a*, 12*b* and seats beneath the thinner plate element 12*b* when assembled therewith, so that the bottom surface of the plate assembly 12 forms a continuous planar surface to facilitate attachment to the door structure. The two stop pins 34*a*, 34*b* are permanently and immovably affixed to the plate element 12*c*, e.g., by interference fit into corresponding passages, threaded attachment, welding, etc. Stop pin passages 38*a* and 38*b* are provided through the thinner portion 12*b* of the plate 12, with the two stop pins 34*a*, 34*b* extending through the corresponding passages 38*a*, 38*b* to extend adjacent to the post 18 when the various components of the security latch are assembled with one another, as shown in FIGS. 1A through 1C and 2. This arrangement allows the post 18 to be threaded into the passage 14 of the plate 12, or more specifically the plate portion 12*b*, through several revolutions without being stopped by the pins 34*a*, 34*b*. Thus, the post 18 can be properly threaded into the post passage 14 to the depth required with the stop flange 36 of the post 18 positioned between the two pin passages 38*a*, 38*b*. The second plate element 12*c* can then be installed beneath the thinner portion 12*b* of the plate 12 with its stop pins 34*a*, 34*b* extending through the pin passages 38*a*, 38*b* to capture the stop flange 36 of the post 18 there between.

Figure 4:
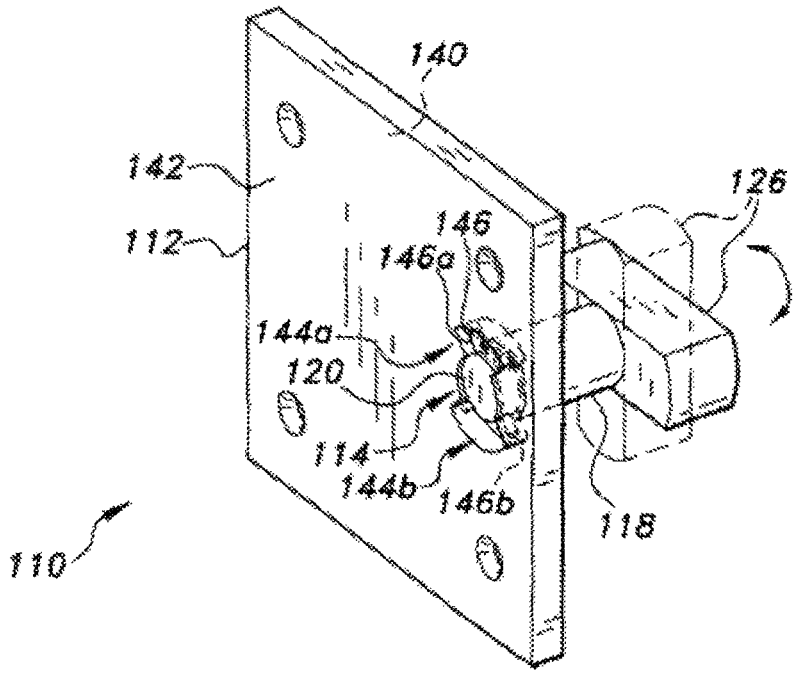
FIG. 4 is a perspective view of an alternative embodiment of the security latch for a swing bar door guard according to the present invention, showing various details thereof.

FIG. 4 of the drawings provides a bottom perspective view of an alternative security latch embodiment, designated as security latch 110. The function of the security latch 110 is identical to that of the security latch 10 of FIGS. 1A through 3, but the structure for limiting the rotation of the stop pin is different. The security latch mechanism 110 of FIG. 4 includes a plate 112 having a post passage 114 formed there through. The attachment end, or end portion, 120 of the post 118 preferably forms a tight frictional fit within the post passage 114 of the plate 112 to preclude inadvertent or unintended rotation of the post 118 and its cross-member 126. Rather than threading the interior of the post passage 114, the bottom surface 142 of the plate 112 includes post rotational stops comprising diametrically opposed first and second recesses 144*a*, 144*b*, each subtending an arc of slightly more than 90 degrees. The attachment end, or end portion, 120 of the post 118 includes a diametrically disposed pin 146 there through, with the pin 146 extending beyond the post 118 to each side thereof to form first and second radially extending protrusions 146*a*, 146*b*. The pin 146, or more specifically its extensions 146*a* and 146*b*, is captured in the corresponding recesses 144*a* and 144*b* to limit rotation of the post 118 and its cross-member 126 to no more than 90 degrees. Assembly may be accomplished by driving the post 118 through the post passage 114 beyond its normal operating depth to expose the end portion 120 of the post 118, pressing or driving the rotational stop pin 146 through a diametric passage (not shown) through the end portion 120 of the post 118, and pushing the post 118 back through the post passage 114 to seat the pin extensions 146*a* and 146*b* within the corresponding recesses 144*a* and 144*b* in the bottom 142 of the plate 112.

The security latch embodiments 10 and 110 described above and illustrated in FIGS. 1A through 4 are adapted for installation with an existing swing bar door guard installation. No removal of any of the components of the existing swing bar door guard installation is needed, as the attachment plate 12 or 112 of the security latch 10 or 110 is a separate component from any of the components of the swing bar door latch. However, in many cases it may be desirable to provide a security latch for a swing bar door guard that is an integral component of the swing bar door guard for new installations.

Figure 5A:
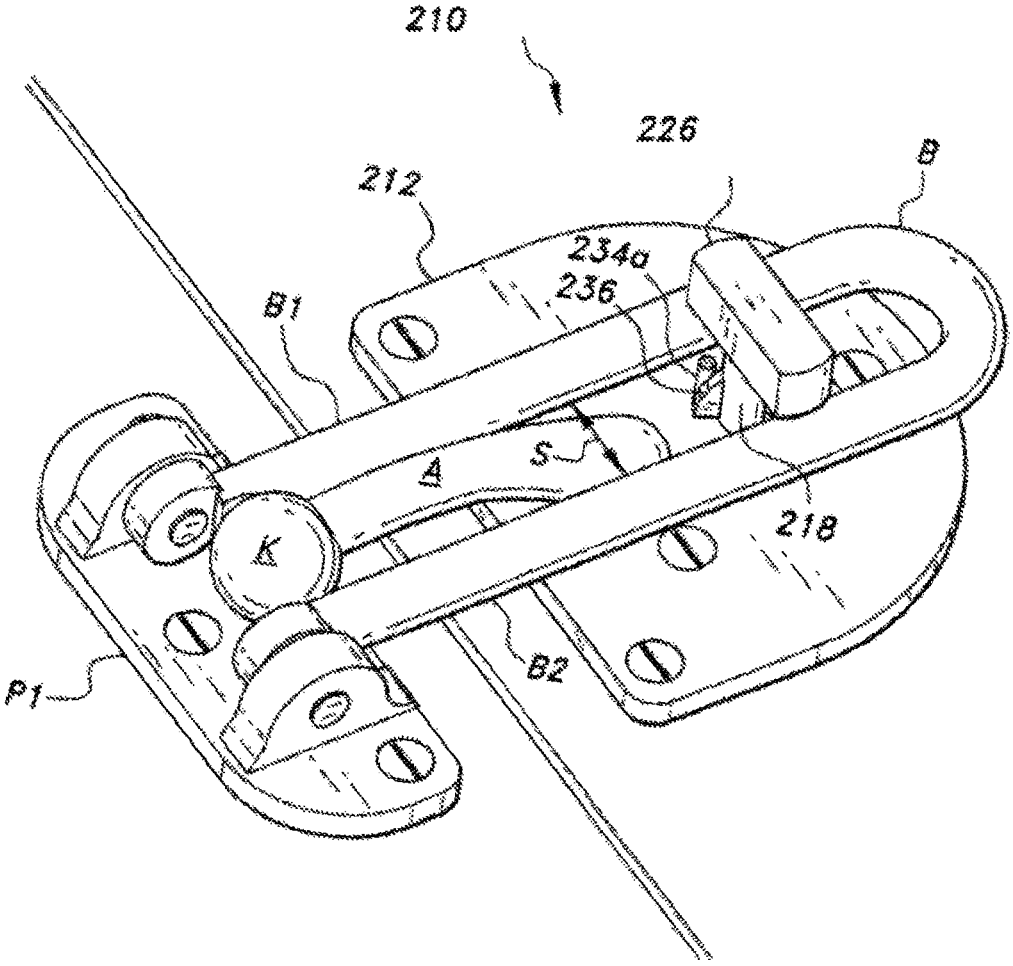
FIG. 5A is a perspective view of another alternative embodiment of the security latch for a swing bar door guard according to the present invention, wherein the mounting plate for the latch is formed integrally with the arm mounting plate of the swing bar assembly.
Figure 5B:
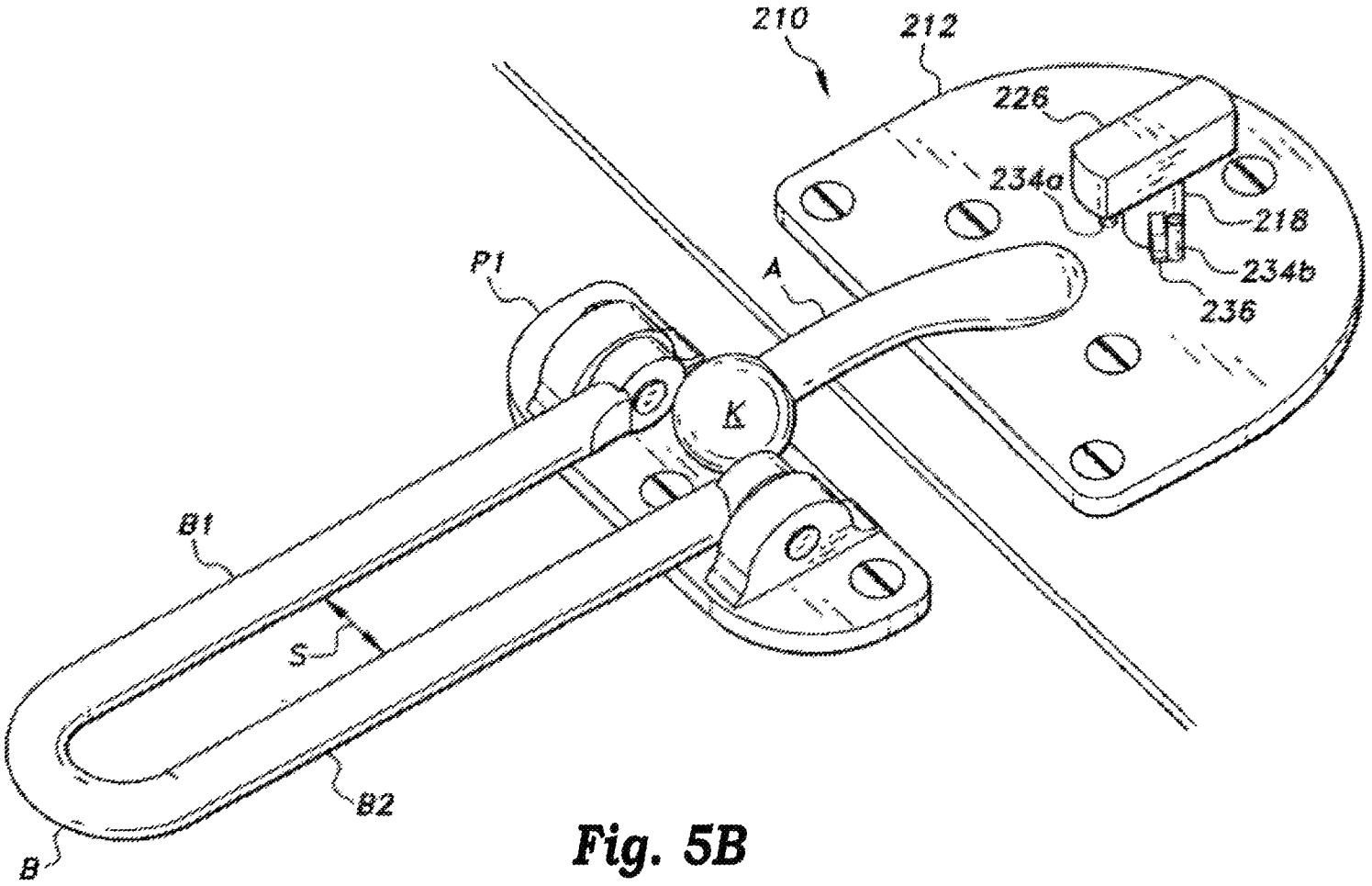
FIG. 5B is a perspective view of the alternative embodiment of the security latch for a swing bar door guard of FIG. 5A, showing the swing bar swung open after disengaging the security latch.

FIGS. 5A and 5B illustrate such an embodiment, designated as security latch 210. The post with its cross-member and its stops are essentially the same as those corresponding components of the first embodiment 10 of FIG. 1A through FIG. 3, comprising a post 218, cross-member 226, first and second stop pins 234*a* and 234*b* (shown in FIG. 5B), and radially protruding flange 236 in the embodiment 210 of FIGS. 5A and 5B. However, rather than providing a post mounting plate separate from the structure of the swing bar door guard, the embodiment 210 of FIGS. 5A and 5B provides a single common plate 212 that includes the rigid arm A of the swing bar door guard extending therefrom and formed as an integral and unitary component therewith. The swing bar door guard is otherwise similar to the swing bar door guard described further above and shown in FIGS. 1A through 1C, having a pivotally acting swing bar B extending from a swing bar mounting plate P1, generally affixed to the door jamb. The swing bar B is formed by two parallel members B1 and B2 having the general configuration of an elongate U. The two members B1 and B2 have a span S there between and define an arm passage for the rigid retaining arm A of the assembly. The arm A has a knob K formed on its distal end, with the knob K passing through a wider gap at the base of the swing bar B but being captured by the relatively narrower span S between the two parallel swing bar members B1 and B2. The retaining arm A is affixed to the same plate 212 as the security latch assembly 210, as noted further above. More specifically, the post 318 and its cross-member 326 have been turned to position the cross-member 326 across the two swing bar members B1 and B2, thus preventing the swing bar B from being moved from its position securing the door. In FIG. 5B, the post 318 and its cross-member 326 have been rotated to align the cross-member 326 with the elongate gap between the two swing bar members B1 and B2, allowing the swing bar B to pass clear of the cross-member 326 and to be swung or pivoted clear of the security latch assembly 310 and the retaining arm A, thereby allowing the door to which the cross-member mounting plate 312 is attached, to be opened.

Figure 6A:
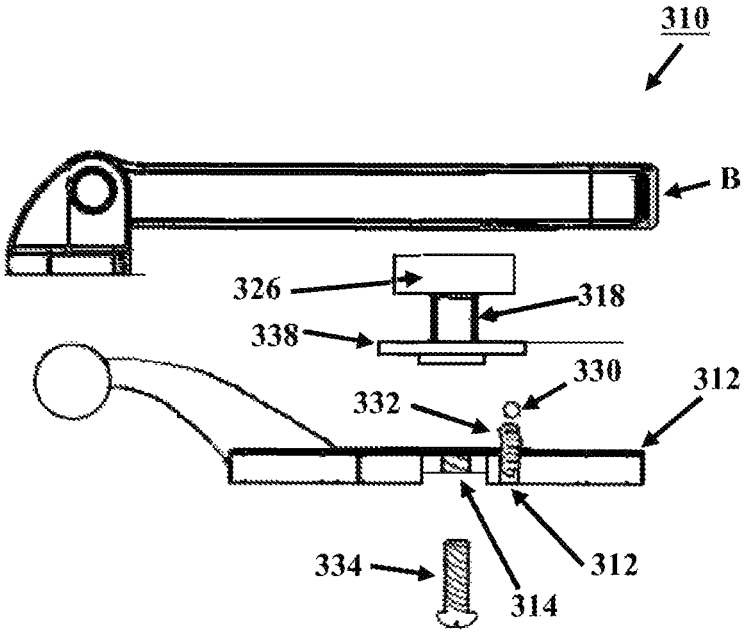
FIG. 6A is an exploded side view another alternative embodiment of the security latch for a swing bar door guard according to the present invention, wherein the mounting plate for the latch is formed integrally with the arm mounting plate of the swing bar assembly.
Figure 6B:
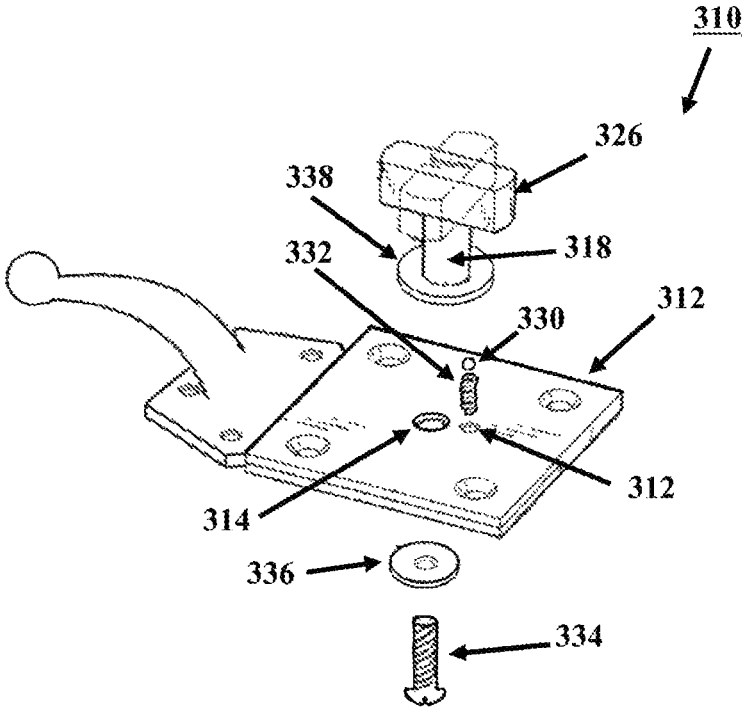
FIG. 6B is a perspective exploded view of the alternative embodiment of the security latch for a swing bar door guard of FIG. 6A, showing the swing bar swung open after disengaging the security latch.

Referring now to FIGS. 6A and 6B, another preferred embodiment is shown wherein the positions of the components of the embodiment 310 in FIGS. 6A and 6B correspond approximately to the positions of the components of the first embodiment 10 in FIGS. 1A and 1C. As shown in FIGS. 6A and 6B, the post 318 defines a circular bottom base portion 338 having underneath a plurality of indentations (not shown). A spring 332 is housed within the plate 12 for supporting a ball bearing 330 wherein when the cross-member 326 is pushed downwardly and turned the ball and spring 330 and 332 respectively, are compressed until aligned with an indentation for retaining the post 318 being frictionally captured in the post passage 314 of cross-member mounting plate 312 such that the post resists free rotation and retains position as set, the post 318 having a diameter adapted for passage through the arm passage of the swing bar B. The post 318 is held into frictional compression through use of a screw 334 and washer 336 for screwing the post 318, circular base 338 and cross-member 326 within plate passage 314 of cross-member mounting plate 312.

Figure 7:
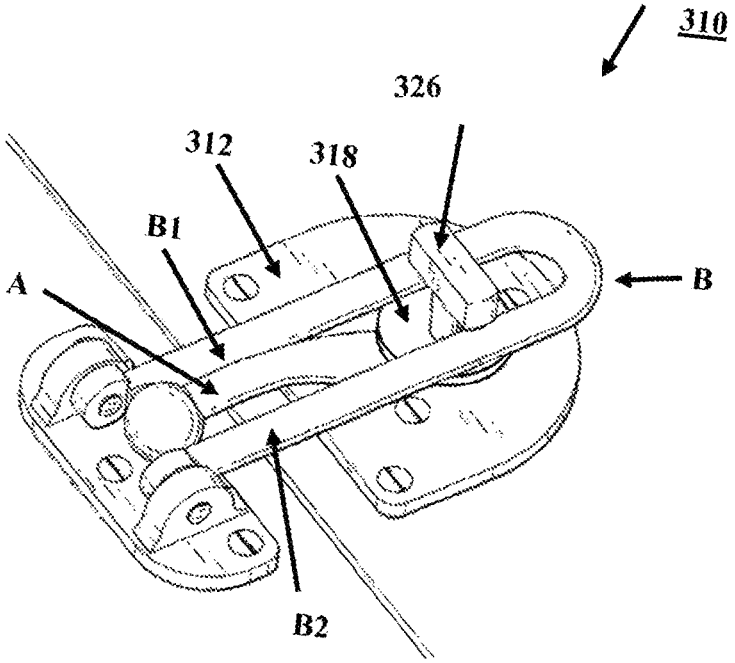
FIG. 7 is a perspective assembly view of the alternative embodiment of the security latch for a swing bar door guard of FIGS. 6A and 6B, showing the swing bar swung open after disengaging the security latch.

Referring now to FIG. 7, the swing bar B is shown swung over the retaining arm A, in position to prevent the door from being opened more than slightly. The post 318 and its cross-member 326 have been turned to position the cross-member 326 across the two swing bar members B1 and B2, thus preventing the swing bar B from being moved from its position securing the door. In FIG. 6A, the post 318 and its cross-member 326 have been rotated to align the cross-member 326 with the elongate gap between the two swing bar members B1 and B2 shown in FIG. 7, allowing the swing bar B to pass clear of the cross-member 326 and to be swung or pivoted clear of the security latch assembly 310 and the retaining arm A, thereby allowing the door to which the cross-member mounting plate 312 is attached, to be opened.

The post with its cross-member and its stops are essentially the same as those corresponding components of the first embodiment 10 of FIG. 1A through FIG. 3, comprising a post 218, cross-member 226, first and second stop pins 234*a* and 234*b* (shown in FIG. 5B), and radially protruding flange 236 in the embodiment 210 of FIGS. 5A and 5B. However, rather than providing a post mounting plate separate from the structure of the swing bar door guard, the embodiment 210 of FIGS. 5A and 1B provides a single common plate 212 that includes the rigid arm A of the swing bar door guard extending therefrom and formed as an integral and unitary component therewith. The swing bar door guard is otherwise similar to the swing bar door guard described further above and shown in FIGS. 1A through 1C, having a pivotally acting swing bar B extending from a swing bar mounting plate P1, generally affixed to the door jamb. The swing bar B is formed by two parallel members B1 and B2 having the general configuration of an elongate U. The two members B1 and B2 have a span S there between and define an arm passage for the rigid retaining arm A of the assembly. The arm A has a knob K formed on its distal end, with the knob K passing through a wider gap at the base of the swing bar B but being captured by the relatively narrower span S between the two parallel swing bar members B1 and B2. The retaining arm A is affixed to the same plate 212 as the security latch assembly 210, as noted further above. More specifically, the post 318 and its cross-member 326 have been turned to position the cross-member 326 across the two swing bar members B1 and B2, thus preventing the swing bar B from being moved from its position securing the door. In FIG. 7, the post 318 and its cross-member 326 have been rotated to align the cross-member 326 with the elongate gap between the two swing bar members B1 and B2, allowing the swing bar B to pass clear of the cross-member 326 and to be swung or pivoted clear of the security latch assembly 310 and the retaining arm A, thereby allowing the door to which the cross-member mounting plate 312 is attached, to be opened.

Figure 8:
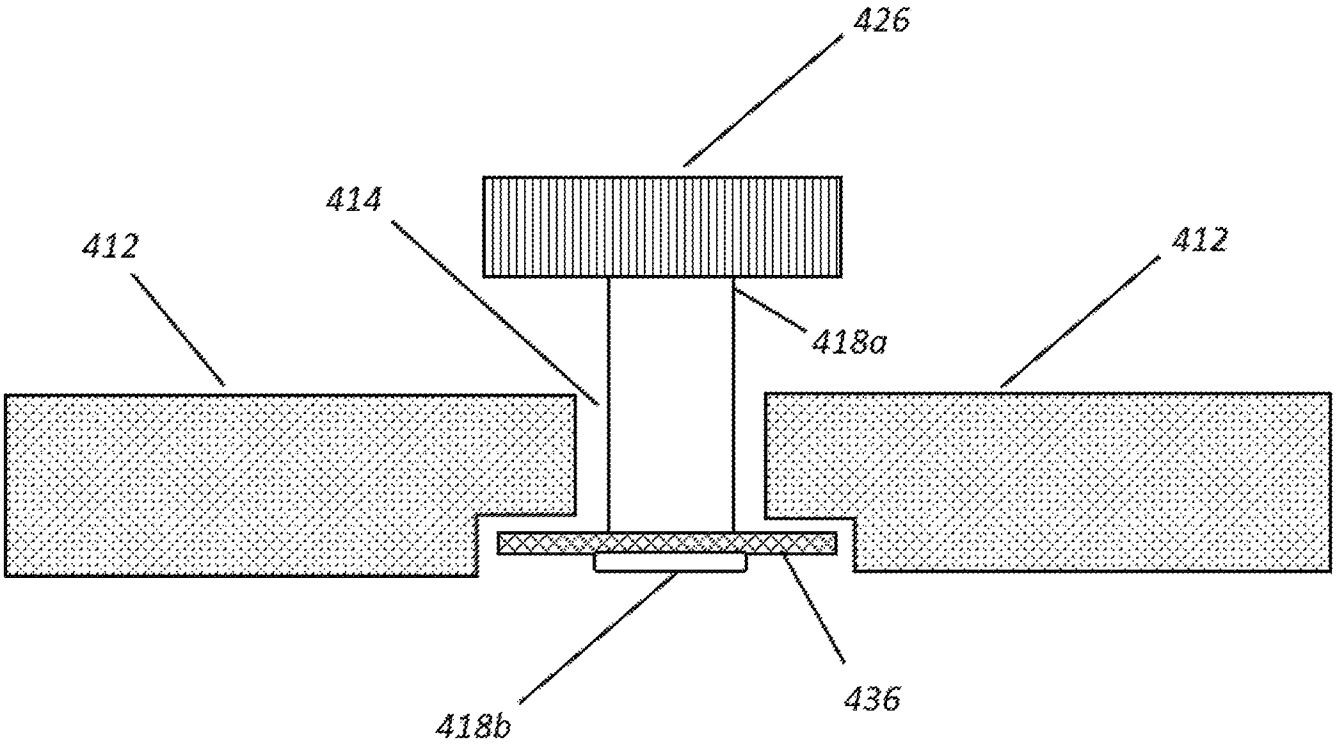
FIG. 8 is a perspective cross sectional view of the alternative embodiment of the security latch for a swing bar door guard showing the cross-member affixed to the cross-member mounting plate by a break-away or shearable fastener.

As depicted in FIG. 8, a further embodiment, the cross-member 426 is configured to break free from the cross-member mounting plate 412 if sufficient force is applied to the door while the cross-member 426 is rotated so as to engage the swing bar B and prevent the door from opening when the knob K traverses the span S between the parallel swing bar members B1, B2. This provides a rescuer the ability to force the door open during an emergency while still providing sufficient security to keep intruders at bay long enough to summon help. Unlike prying the parallel members B1, B2 apart, the application of sufficient force to cause the cross-member 426 to break away from the cross-member mounting plate 412 is likely to be noisy and require multiple attempts by the intruder, thus given the occupant additional time to prepare, summon help, and respond with force if necessary. The small opening resulting between the door and the doorway when the door is opened while the cross-member 426 is securing the swing bar B is large enough to facilitate communication of sound across the doorway but too small to permit the entry of a tool between the parallel swing bar members B1, B2 along the mid-section of the swing bar B and away from the swing bar mounting plate P1 where the application of pressure could easily pry the parallel members B1, B2 apart so as to increase the distance of the span S to the point where the knob K could pass between the swing bar members B1, B2 and permit the door to open.

In an embodiment, the cross-member post 418 having a cross-member 426 affixed to a post top end 418*a*. The post 418 passes through the cross-member mounting plate 412 through the post passage 414 and is configured to break free from a post fastener 436 secured to the bottom end of the post 418*b* beneath the cross-member mounting plate bottom surface 442 so as to prevent the bottom end of the post 418*b* from passing through the post passage 414, thus inhibiting the removal of the cross-member 426 from the cross-member mounting plate 412. Similar means of decoupling the cross-member 426 from the cross-member mounting plate 412 would include shearing bolts, rivets with shearable heads, shear collars, and other mechanisms known in the field of fasteners. A minimally sufficient force required to cause said cross-member 426 to break away from said cross-member mounting plate 412 is believed to be equivalent to at least 100 lbs of force, and preferably at least 150 lbs of force.

It is to be understood that the present invention is not limited to the embodiments described above, but encompasses any and all embodiments within the scope of the following claims.

What is claimed is:

1. A security latch for securing a swing bar, comprising:

a plate having a post passage defined there through;

a post arranged to pass through said post passage, having a post bottom end that lies beneath said plate and a post top end that lies above said plate;

a cross-member disposed at said post top end and which is configured to be received within and pass through an arm passage consisting of a span between parallel members of a swing bar, said cross-member having a width adapted for passage through an arm passage of said swing bar and a length greater than the span of said arm passage of said swing bar so that said cross-member will secure said swing bar to said plate when rotated to extend said length across said span after passing through said arm passage;

a stop disposed at said post bottom end beneath said plate, wherein said stop is larger than said post passage;

a point of structural weakness configured at said stop to permit said cross-member to break away from said plate with the application of sufficient force; and a swing bar retaining arm which acts to retain said swing bar when said swing bar is not retained by said cross-member.

2. The security latch of claim 1, wherein said cross-member is arranged at a sufficient distance from said plate to permit the slight opening of a door having said swing bar secured by said cross-member so as to facilitate the communication of sound across a doorway but not permitting a large enough gap to allow the introduction of a tool intended to pry said parallel members of said swing bar apart along a midsection of said swing bar so as to cause a knob to pass through said span.

3. The security latch of claim 1, wherein said stop disposed at said post bottom end is said point of structural weakness in that said stop disposed at said post bottom end is configured to break away from said post with the application of sufficient force to create said point of structural weakness.

4. The security latch of claim 3, wherein said cross-member is configured to rotate no more than 90° relative to the length of said swing bar.

5. The security latch of claim 3, wherein said stop is configured to break away from said post bottom end with the application of at least 100 pounds of force.

6. The security latch of claim 1, wherein said cross-member is said point of structural weakness in that said cross-member is configured to break away from said post top end with the application of sufficient force.

7. The security latch of claim 1, further including a spring supported ball bearing comprised of a spring and a ball bearing, said spring supported ball bearing being housed within said plate and arranged so that when said cross-member is pushed downwardly and turned, said ball bearing and said spring are compressed until aligned with an indentation for retaining said post which is frictionally captured in said post passage of said plate such that said post resists free rotation and retains a set position.

8. A security latch for securing a swing bar engaged with a swing bar retaining arm, comprising:

a plate having a post passage defined there through;

a post arranged to pass through said post passage, having a post bottom end that lies beneath said plate and a post top end that lies above said plate;

a cross-member disposed at said post top end which is configured to be received within and pass through an arm passage consisting of a span between parallel members of said swing bar, said cross-member having a width adapted for passage through said arm passage of said swing bar and a length greater than the span of said arm passage of said swing bar so that said cross-member will secure said swing bar when rotated to extend said length across said span after passing through said arm passage;

a stop disposed at said post bottom end; and a point of structural weakness configured at said stop to permit the cross-member and post to break away from said plate with the application of sufficient force.

9. The security latch of claim 8, wherein said cross-member is arranged at a sufficient distance from said plate to permit the slight opening of a door having said swing bar secured by said cross-member so as to facilitate the communication of sound across a doorway but not permitting a large enough gap to allow the introduction of a tool intended to pry said parallel members of said swing bar apart along a midsection of said swing bar so as to cause a knob to pass through said span.

10. The security latch of claim 9, further including a spring and a ball bearing housed within said plate wherein said spring is arranged to support said ball bearing and is arranged so that when said cross-member is pushed downwardly and turned, said ball bearing and said spring are compressed until said ball bearing is aligned with an indentation for retaining the post which is frictionally captured in the post passage of the plate such that the post resists free rotation and retains a set position.

11. The security latch of claim 8, wherein said stop is configured to break away from said post bottom end with the application of at least 100 pounds of force.

12. The device of claim 8, wherein said stop is larger than said post passage.

13. A security latch for securing a swing bar engaged with a swing bar retaining arm, comprising:

a plate having a post passage defined there through;

a post arranged to pass through said post passage, having a post bottom end that lies beneath said plate and a post top end that lies above said plate;

a cross-member disposed at said post top end and which is configured to be received within and pass through an arm passage consisting of a span between parallel members of said swing bar, said cross-member having a width adapted for passage through said arm passage of said swing bar and a length greater than said span of said arm passage of said swing bar so that said cross-member will secure said swing bar when rotated to extend said length across said span after passing through said arm passage, said cross-member being arranged at a sufficient distance from said plate to permit the slight opening of a door having said swing bar secured by said cross-member so as to facilitate the communication of sound across a doorway but not permitting a large enough gap to allow the introduction of a tool intended to pry said parallel members of said swing bar apart along a midsection of said swing bar so as to cause a knob of said swing bar retaining arm to pass through said span;

a stop disposed at said post bottom end and configured to break away from said post bottom end with the application of at least 100 pounds of force.

14. The security latch of claim 13, further including a spring and a ball bearing housed within said plate wherein said spring is arranged to support said ball bearing and is arranged so that when said cross-member is pushed downwardly and turned, said ball bearing and said spring are compressed until said ball bearing is aligned with an indentation for retaining the post which is frictionally captured in the post passage of the plate such that the post resists free rotation and retains a set position.

15. The device of claim 13, wherein said stop is larger than said post passage.

* * * * *